United States Patent [19]

Boettcher

[11] 4,093,494

[45] June 6, 1978

[54] SECURING MEANS FOR PARQUET FLOOR BOARDS

[76] Inventor: William A. Boettcher, 4507 N. Clark St., Chicago, Ill. 60640

[21] Appl. No.: 795,171

[22] Filed: May 9, 1977

[51] Int. Cl.[2] ..... B44C 7/00; B32B 31/00

[52] U.S. Cl. ..... 156/577; 156/579

[58] Field of Search ..... 156/71, 577, 579

[56] References Cited

U.S. PATENTS DOCUMENTS

| | | | |
|---|---|---|---|
| 1,739,296 | 12/1929 | Du Pont | 156/577 |
| 2,546,308 | 3/1951 | Kahler | 156/577 |
| 3,871,940 | 3/1975 | Antoniowi | 156/577 |

*Primary Examiner*—Douglas J. Drummond
*Attorney, Agent or Firm*—S. J. Lehrer

[57] ABSTRACT

A machine for laying parallel sets of tapes on a floor preparatory to laying parquet boards on the tapes. Elevated supports for a pair of tape rolls are carried between side walls of the machine, and for a third roll outside of one wall, with all the rolls in horizontal alinement. The machine has bottom rollers for floor travel and alined with the tape rolls to receive tapes from the same. These are trained in rearward direction under the rollers, and have an adhesive under surface to become attached to the floor as the machine is moved in forward direction. Guide means are provided to procure parallelism for succeeding sets of tapes with the ones first laid. The laid tapes have a protective covering removable to expose an adhesive surface on which the parquet boards are laid.

2 Claims, 4 Drawing Figures

SECURING MEANS FOR PARQUET FLOOR BOARDS

This invention relates to surface boards—called parquet—which are laid on floors to lend them an ornamental appearance; and such boards are usually secured to the floors by glue to remain permanently attached. Where premises are to be abandoned, or a building wrecked, layers of parquet boards in various rooms may still be in good shape; or, they may have been laid recently. Yet, such parquet floors become a total loss when they remain with the floors in the building abandoned or wrecked.

In view of the above situation, it is one object of the present invention to provide means for attaching the parquet boards securely when laid, yet removable when they no longer have to remain on the floors where laid, in order that such boards may be applied to other floors to serve as usefully as before.

A further object is to provide means for first laying a set of tapes on the floor designed to receive the parquet boards, the tapes having their upper and lower surfaces sticky, so that the lower ones may adhere to the floor and the parquet boards adhere to the upper surfaces when laid thereon.

Another object is to provide a machine for laying a series of tapes in a direct course on the floor, the tapes having a covering on the upper side as laid, and such covering being peeled off when the parquet boards are ready to be laid on the tapes.

An additional object is to provide a machine for the above purpose which has rollers for dispensing and laying a series of companion tapes as the machine is moved in forward direction in a manner to support and secure a layer of parquet boards subsequently deposited on the tapes.

Another object is to construct the machine with means for laying the first tape closely along a wall, while providing an adequate clearance for the user's hand when applied to the machine in the region of the wall.

A final object is to provide a machine which has features of stability, lateral adjustment for the tapes, and efficient operation.

A better understanding of the invention may be gained by reference to the accompanying drawing, in which—

Figure 4:
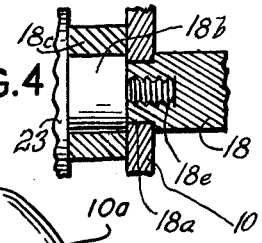
FIG. 4 is a section of a detail in the bottom left-hand corner of FIG. 1.

Parquet floor boards are usually square and between four and eight inches wide; and according to the present invention a set of spaced linear adhesive tapes is laid on a floor, and the parquet boards secured on the tapes to receive adequate support at frequent intervals and where low spots occur in the floor.

The machine mentioned above provides a handy facility for properly laying the tapes as the machine is pushed in forward direction. Thus, specific reference to the drawing indicates the sides of the machine as a pair of walls 10 and 11, which rise to form handles 10*a*. A pair of alined tubular cylinders are secured in an elevated horizontal position between the walls 10 and 11. Thus, cylinder 12 receives the wall 10 at a medial point, while cylinder 13 meets the wall 11 from the inside, as indicated by dotted lines 13*a* in FIG. 1; and a wide space occurs between the inner ends of the cylinders.

The present machine is designed to receive a set of freely mounted tape rolls 15 on the cylinders mentioned above. Thus, one roll is mounted on the outer half of the cylinder 12, a second roll on the inner half, and a third roll on the cylinder 13, as clearly shown in the center of FIG. 1. The tapes, drawn forwardly from the bottom of the rolls, are sticky on both sides. However, the under side has a protective covering.

Figure 2:
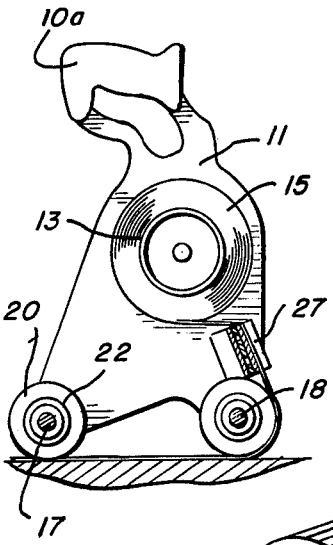
FIG. 2 is a section on the line 2—2 of FIG. 1, on a reduced scale.

Means for supporting the machine for forward travel originates with rear and frontal cross-shafts 17 and 18 visible in FIG. 2. The cross-shaft 17 is secured between the side walls 10 and 11 by perforating the same to receive the ends of the shaft with a press-fit as shown at 18*a* in FIG. 4; or, the shaft may be secured to the walls in other ways. It carries freely-mounted rubber rollers 20 next inside the machine walls; and collars 22 are secured on the cross-shaft to keep the rollers in place. The cross-shaft 18, like the cross-shaft 17, is made fast to the machine walls, but receives an extension 18*b* outside the wall 10. The extension first receives a secured collar 18*c*, then a freely mounted roller 23, and finally a secured collar 18*d*, as seen in the left-bottom corner of FIG. 1. FIG. 4 shows a simple way to connect the extension 18*b* by threading a nipple 18*e* from the same into the end of the cross-shaft. Frontal rubber rollers 23 are freely mounted on the cross-shaft 18 and its extension, and register with the tape rolls mounted as described.

Figure 1:
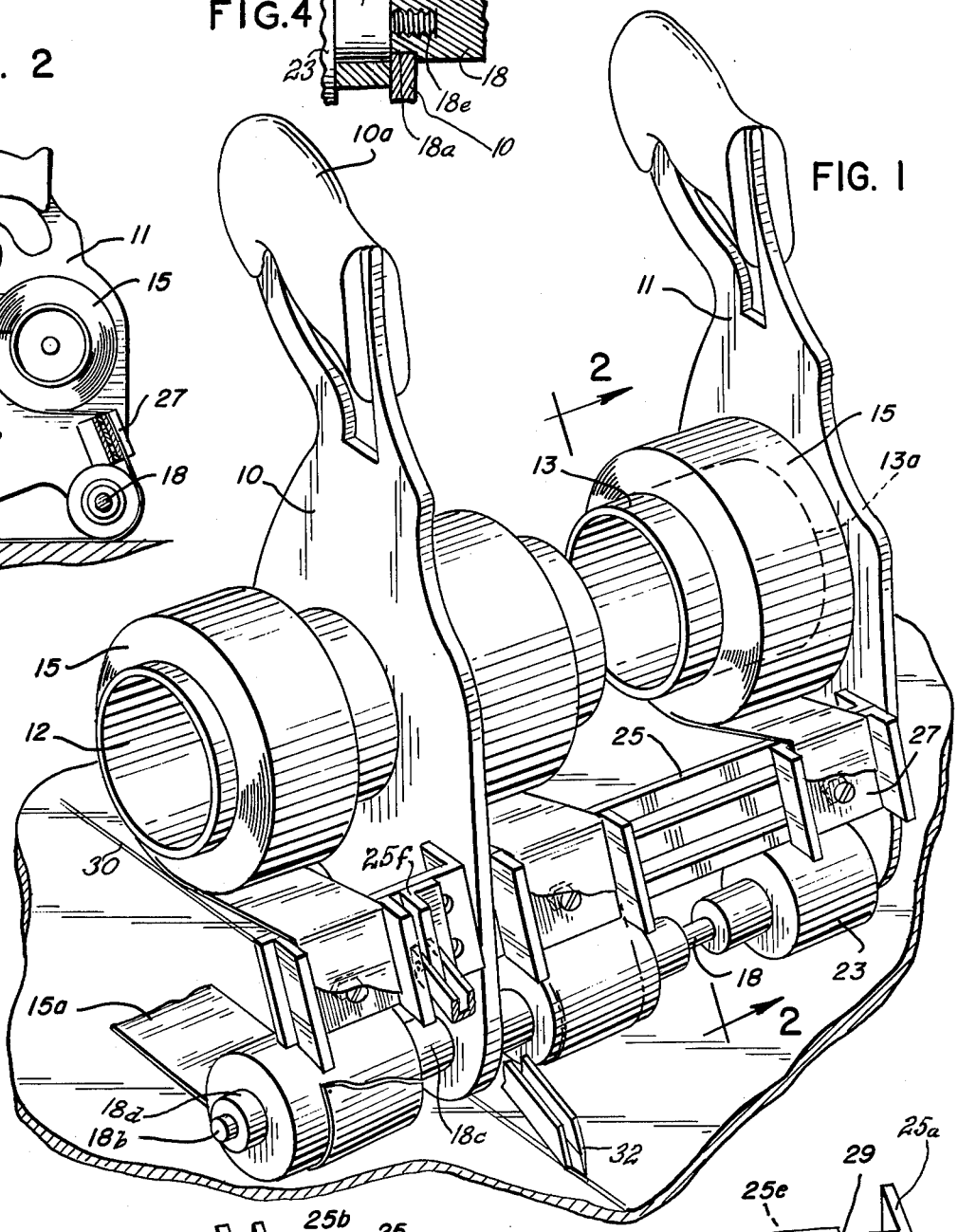
FIG. 1 is a perspective view of the frontal portion of the machine.

When a set of tapes are to be laid on a floor, the machine is set at the origin of its travel with the outer half of the cylinder 12 against the right-hand wall of the premises after the tapes issuing from the rolls 15 have been trained under the frontal rollers 23 to extend rearwardly, a tape so trained appearing at left-bottom in FIG. 1. Now the protective covering is on the upper side, and indicated at 15*a* in the left-bottom part of FIG. 1. With the machine set on the floor the tapes will adhere to the same, and continue to do so as the machine is pushed in forward direction by means of the handles 10*a* toward the remote wall of the premises. Now the set of tapes has been fully laid, and may be cut off immediately behind the rollers 23. The machine may now be raised and re-set at positions laterally of the laid tapes to deposit a second and succeeding sets of tapes in the same manner.

The walls of the machine also receive a tie bar 25 in front, terminal bends 25 thereof having holes 25*b* for means securing the tie bar to the walls of the machine. An extension 25*c* of the tie bar applies to the outer side of the wall 10, and is secured to it in the same manner as the tie bar. The latter and the extension carry channel plates 27 for the downward guidance of the tapes from the rolls 15 to keep them alined with the rollers 23 below. Since the tapes may need lateral adjustment, the channel plates 27 receive bolts 29 passing through horizontal slots 25*d* made in the tie bar and its extension to receive nuts 25*e* on the back side and be made fast at any point of lateral adjustment.

It is now apparent that the side wall of the premises has served as the guide or straight-edge for laying the first set of three tapes in a straight course. Also, due to the projection of the outer half of cylinder 12 from the right-hand wall 10 of the machine, clearance is afforded for the hand holding the handle 10*a* in the space next to the wall; and this space also renders visible the course of the outer half of cylinder 12 to keep it in contact with the wall of the premises and insure the laying of the first tape close to it.

Figure 3:
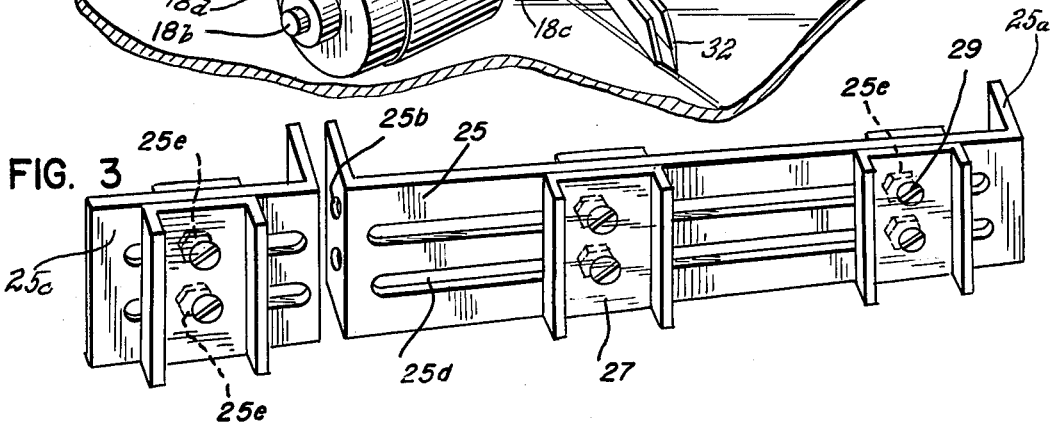
FIG. 3 is an enlarged perspective view of a tie bar located in the front of the machine.

In the use of the machine it is important to space the second set of tapes properly from the first one. For this purpose a chalk line 30 is drawn on the floor of the premises where the second set of tapes would extend. FIG. 1 shows a pivoted pointer 32—partly broken away—projecting from a bracket 25*f* carried by the tie bar extension 25*c* and directed to the chalk line 30 to guide the progress of the machine; and new chalk lines are drawn for guiding succeeding sets of tapes. FIG. 3 shows how the pointer is attached to the tie bar. After the tapes have been laid across the floor, walking on them will do no harm, since the exposed tape coverings 15*a* are non-adherent. Therefore, the laying of the parquet boards may be started and continued after peeling the coverings off to expose the sticky surfaces of the tapes, until the entire parquet surface has been laid.

It is now apparent that the present machine is a facility designed for the multiple laying of tapes with the saving of time and labor. Means are provided for the correct guidance of the tapes during the laying process and the comfortable handling of the machine when it is moved along a wall. Further, the space within the machine between cylinders 12 and 13 is wide enough for the easy removal and replacement of tape rolls by sliding manipulation. Finally, when the premises are to be abandoned or wrecked, the parquet boards may be pried one by one off the tapes, and saved for use elsewhere.

I claim:

1. Securing means for parquet boards designed to be laid on a floor, comprising a machine adapted to travel in a direct course on the floor, transverse cylinder means mounted in the machine and carrying a series of rotatable rolls from which tapes adhesive on the under side may be drawn to adhere to the floor during said travel, the tapes showing a protective covering on the upper side when laid, and such covering removable to allow the parquet boards to be laid on said upper side into adhering engagement with the tapes, the machine having a pair of side walls receiving said cylinder means between them, a frontal tie bar carried by said walls, channel plates carried by the tie bar in line with the tapes, and means to adjust the channel plates according to lateral adjustments of the tapes.

2. The structure of claim 1, said frontal tie bar having horizontal slots, channel plates carried by the tie bar in line with the tapes, and securing means passing through said slots to fix positions of the channel plates according to lateral adjustments of the tapes.

* * * * *